US005175888A

United States Patent [19]

Clark

[11] Patent Number: 5,175,888

[45] Date of Patent: Jan. 5, 1993

[54] OUTERWEAR GARMENT WITH DISPLAY FEATURE

[76] Inventor: Harold E. Clark, 412 S. 13th St., P.O. Box 808, Sunnyside, Wash. 98944

[21] Appl. No.: 911,763

[22] Filed: Jul. 9, 1992

[51] Int. Cl.[5] ..... A41B 1/00

[52] U.S. Cl. ..... 2/243 R; 2/115; 2/106; 2/105; 2/244; 40/586; D2/208; D2/209; D2/215

[58] Field of Search ..... 2/243 R, 243 B, 115, 2/106, 105, 121, DIG. 1, 244, 272, 247, 249, 250; 40/586; D2/208, 209, 215

[56] References Cited

U.S. PATENT DOCUMENTS

| | | | |
|---|---|---|---|
| 1,756,083 | 4/1930 | Brenner | 2/243 R |
| 1,799,572 | 4/1931 | Sweeney | 2/115 |
| 4,813,081 | 3/1989 | Cliff et al. | 2/244 |
| 5,001,782 | 3/1991 | Stewart | 2/243 B |

*Primary Examiner*—Andrew M. Falik
*Assistant Examiner*—Gloria Hale
*Attorney, Agent, or Firm*—Wells, St. John, Roberts, Gregory & Matkin

[57] ABSTRACT

An outerwear garment having a highly unique design and display feature. The outerwear garment of a particular fabric material includes a plurality of parallel slits which form a plurality of strips of fabric within a visual area. A display panel is secured to the inside of the fabric material such that a depiction is positioned to correspond to the visual area and partially visible through the slits. The slits may be cut generally horizontally, vertically, or at an inclined angle. When the fabric material is wetted, the strips become distorted in various ways to reveal increased portions of the respective depictions within the respective visual areas. Multiple visual areas can be created on the garment to provide an unlimited number of different designs, patterns, textures, and visual effects.

21 Claims, 5 Drawing Sheets

OUTERWEAR GARMENT WITH DISPLAY FEATURE

TECHNICAL FIELD

This invention relates to clothing, and more particularly, to outerwear garments.

BACKGROUND OF THE INVENTION

The fashion and clothing industry depends upon the constant creation of new designs and clothing products which will appeal to consumers. Various types of clothing including new designs, colors, and shapes are continually being designed and manufactured in an effort to discover a unique look that will be trend-setting in nature. A pioneering fashion design having tremendous consumer appeal comes about very infrequently.

Traditional items of outerwear clothing consist primarily of a piece of material constructed in a particular shape, size, style, color, and design pattern. Such traditional outerwear clothing is commonly constructed of a single layer of material. Traditional outerwear clothing has sometimes been designed to be worn in multiple layers and to cover different parts of the body.

Because of the difficulty in creating new, appealing clothing designs, the fashion industry sees much repetition with respect to the construction and design of outerwear clothing. A common occurrence in the fashion and clothing industry is that clothing styles popular in prior years resurface and become once again popular in a cyclical manner.

One type of traditional outerwear clothing design involves a ragged or worn look in which some of the material has been worn away to expose the skin or undergarment of the person wearing the worn piece of clothing. The worn areas can result from normal wear and tear, or garment can be manufactured to include worn areas. Such worn areas can be manufactured at any location on the garment.

Outerwear clothing manufactured to include worn areas suffer, however, from several drawbacks. First, the worn areas must be created by destroying the fabric material within the worn area. Second, the manufacturing process of destroying the fabric material within the worn area is time consuming, expensive, and labor-intensive. Finally, the structural integrity of the garment must often be compromised where the worn area is created, commonly at location where maximum structural support is required.

Accordingly, a need exists to provide a new type of outerwear clothing which involves a pioneering design and has a high degree of consumer appeal yet preserves, where necessary, the structural integrity of the garment. The present invention, described in detail below, involves a new type of outerwear clothing that differs dramatically from traditional clothing construction. Outerwear clothing constructed according to the present invention creates a dramatic first impression upon consumers because of its highly unique design characteristics. The outerwear clothing of the present invention maintains a high degree of structural integrity of the fabric material. Other advantages, features, and objects of the present invention will become apparent from the detailed disclosure of the invention as set forth below.

BRIEF DESCRIPTION OF THE DRAWINGS

One or more preferred forms of the invention are described herein with reference to the accompanying drawings. The drawings are briefly described below.

DETAILED DESCRIPTION OF THE INVENTION

This disclosure of the invention is submitted in furtherance of the constitutional purposes of the U.S. Patent Laws "to promote the progress of science and useful arts" (Article 1, Section 8).

Figure 1:
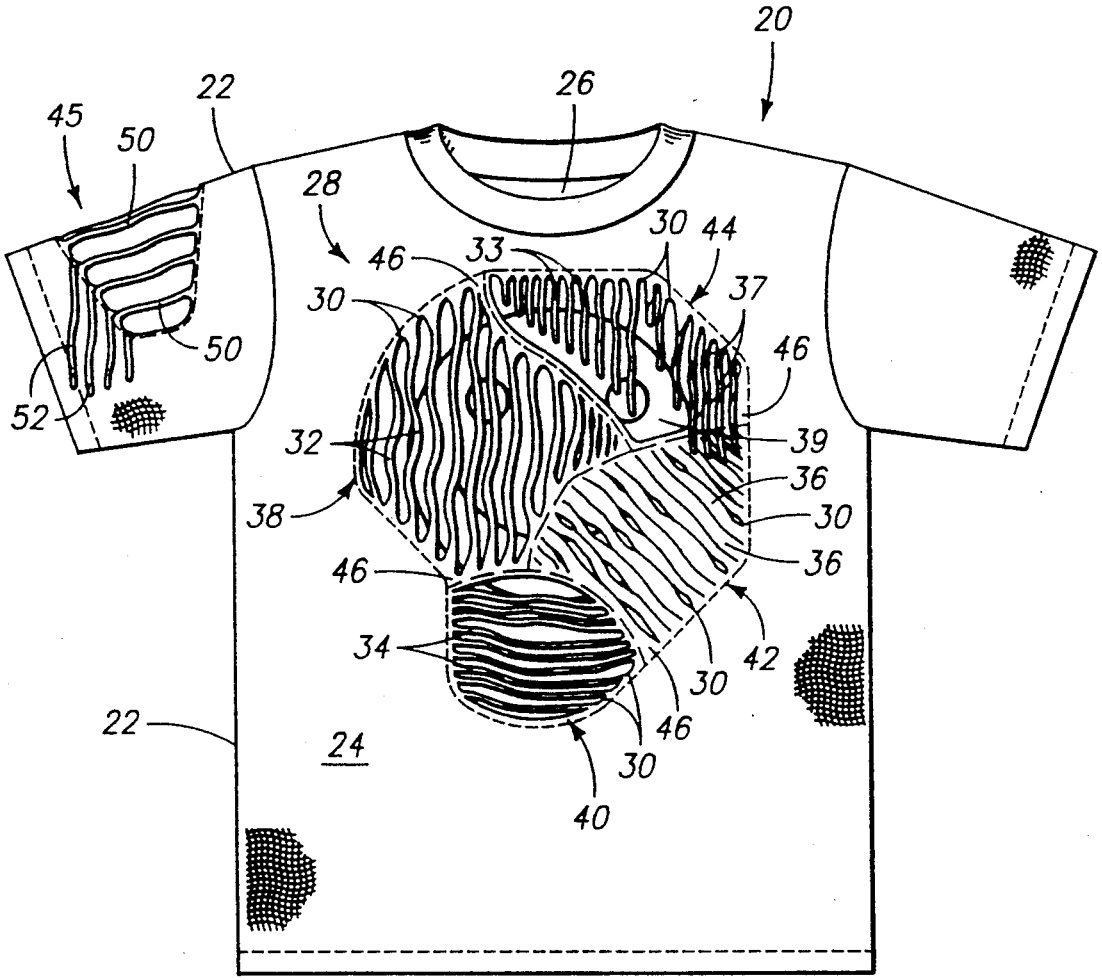
FIG. 1 is a front view of an item of outerwear clothing constructed according to the present invention.

FIG. 1 shows an outerwear clothing item 20 constructed according to the present invention. Although the clothing item 20 is shown as a shirt, it is understood that any type of outerwear garments, such as tee shirts, shorts, socks, ties, caps, and other clothing items, could be made according to the present invention.

The clothing item 20 includes a main fabric piece 22 having an outer side 24 and an inner side 26. The outer side is intended to be exposed to the exterior of the garment and outwardly visible. The inner side 26 is intended to be worn against a person's body or undergarment (not shown).

A visual area 28 having a plurality of substantially parallel slits 30 is formed on in the fabric piece 22. The visual area 28 could consist of a single, large visual area (as shown in FIG. 1) or two or more separated visual areas. Although the visual area 28 is shown to be generally centered on the front of the shirt, it is understood that the visual area 28 could be located at any location on the clothing item 20.

The groups of parallel slits 30 are shown in FIG. 1 to be oriented in various directions. It should be further understood that the number and location of parallel slits 30 may vary. Also, the orientation of the groups of slits may be at various angles relative to horizontal and vertical fabric directions. This variation capability allows the clothing item 20 to be constructing to include an unlimited number of different designs, textures, styles, and visual effects.

Referring still to FIG. 1, the slits 30 form a plurality of fabric strips: attached vertical strips 32; vertical strips 33, each having an end detached from the fabric piece 22; attached horizontal strips 34; inclined strips 36; and helically twisted vertical strips 37, each having an end detached from the fabric piece 22. As discussed below, each of the fabric strips 32, 33, 34, 36, 37 deforms in a unique manner depending upon the orientation of the slits and the type of material used for the fabric piece 22.

The visual area 28 shown in FIG. 1 comprises four separate design areas, including a first visual area 38, a second visual area 40, a third visual area 42, and a fourth visual area 44. Although these visual areas are oriented adjacent one another, it should be understood that the design areas could be separated and arranged at any location on the clothing item 20. The visual areas 38, 40, 42, 44 shown in FIG. 1 are simply representative of the many various configurations of designs that can be carried out within the spirit of the present invention.

The various visual areas 38, 40, 42, 44 are separated by fabric ribs 46. The ribs 46 provide a fabric structure to which a display panel 48 can be secured to provide a structural support for the panel 48. The panel 48 is shown to be sewn onto the ribs 46 along the dashed lines within visual area 28. The combination of the display panel 48 and the ribs 46 maintains the structural integrity of the garment. The panel 48 may include any type of design or depiction 39. For simplicity, the depiction 39 of FIG. 1 shows a smiling face. The depiction 39 can be seen through the slits formed in between the various strips of fabric material 32, 33, 34, 36, 37. The amount of the depiction 39 visible through the slits will depend upon the length, the number, and the extent of deformation of the fabric strips, which will be explained in detail below.

Figure 2:
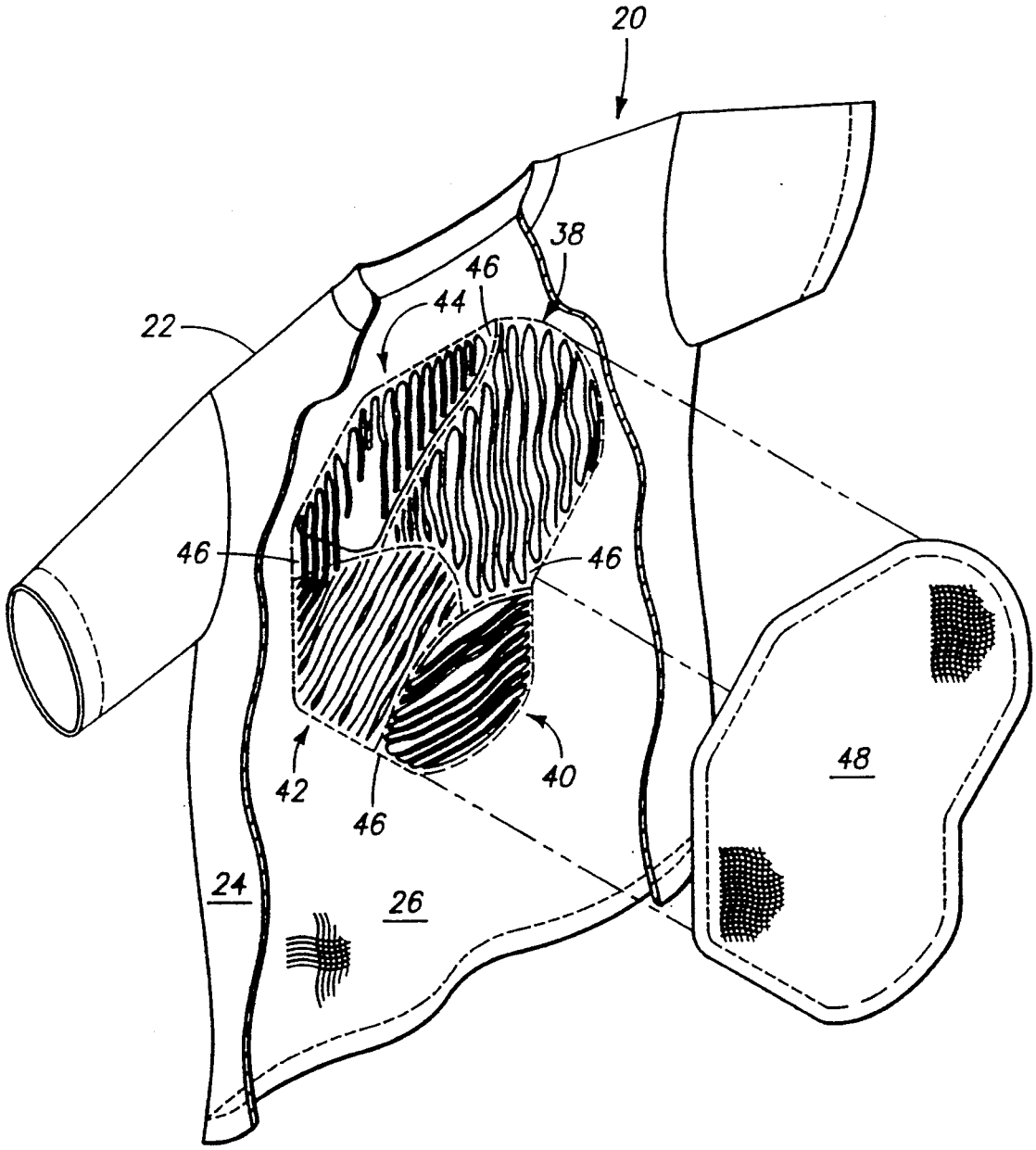
FIG. 2 is an exploded rear perspective view, partly in section, of the outerwear clothing item of FIG. 1.

FIG. 2 shows a rear view of the panel 48 being in a separated position relative to the fabric piece 22 (the depiction or smiling face 39 is not visible from the rear). Although the embodiment shown in FIG. 2 shows a single panel being secured to the inner side 26 of the clothing item 20 (along the dashed lines shown in FIG. 1), it is to be understood that multiple small panels with different depictions could be secured to correspond to each visual area on the fabric piece 22.

Referring again to FIG. 1, an additional visual area 45 is shown on a sleeve portion of the clothing item 20. The visual area 45 includes alternating strips of fabric 50, 52, the strips 50 being attached at both ends to the fabric piece 22 and the fabric strips 52 being detached at one end from the fabric piece 22. A panel (not shown) may or may not be secured behind the visual area 45, depending on the desired visual affect. A panel mounted behind visual area 45 might include a visual depiction which could be visible between the fabric strips 50. Alternatively, a panel could be omitted from the visual area 45 so that the skin or undergarment (not shown) of the person wearing the clothing item 20 can be visible, particularly where it is unnecessary to maintain the structural integrity of the garment.

Figure 3:
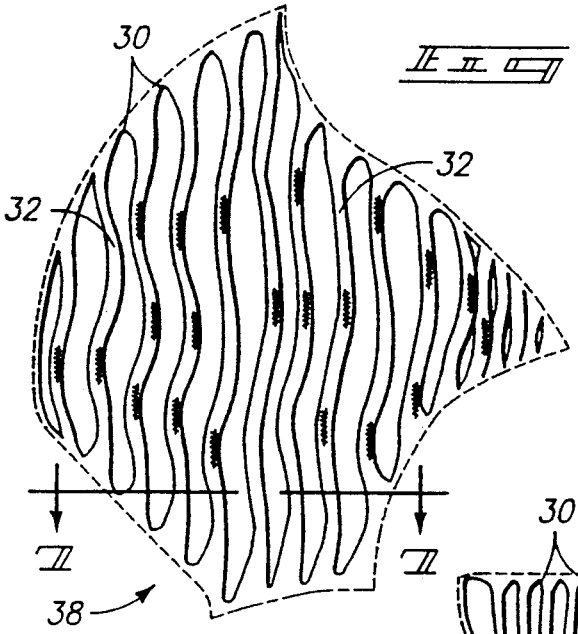
FIG. 3 is an enlarged, partial front view design area on the clothing item of FIG. 1.

The type of fabric material used as the fabric piece 22 and the direction of slits 30 will determine the amount of deformation of the strips of fabric material. FIGS. 3–6 show enlarged views of the various visual areas, 38, 40, 42, 44, shown in FIG. 1 to better show the construction of the present invention. FIG. 3 shows visual area 38 in which the slits 30 are oriented in generally a vertical direction. Fabric strips 32 are formed by the vertical slits 30 which, as a result of the fabric used in constructing the garment of the present invention, curls about a longitudinal axis of the fabric strips toward the inner side 26 of the fabric piece 22. FIG. 7 is a cross sectional view of one such fabric strip 32 which shows this type of curling in greater detail.

Figure 4:
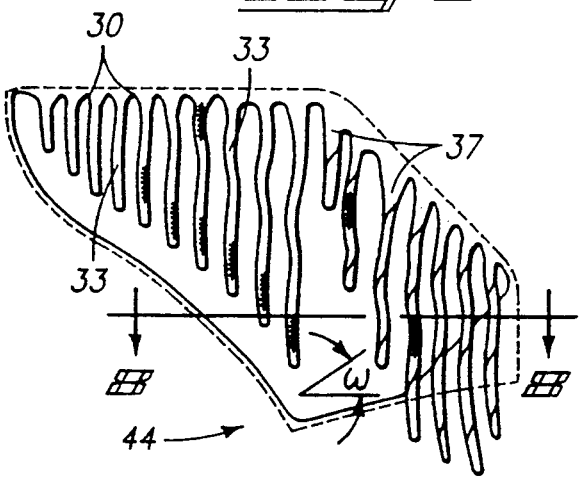
FIG. 4 is an enlarged, partial front view of another design area on the item of outerwear clothing of FIG. 1.

FIG. 4 shows a combination of fabric strips 33, 37 created by providing parallel slits 30 in two different directions. On the left side of FIG. 4, the fabric material 22 is shown to be cut in a generally vertical direction and detached at one end to form detached, vertical fabric strips 33. The detached, vertical strips 33 curl toward the inner side 26 of the fabric material 22, in the same manner the fabric strips 32 of FIG. 3 curl toward the inner side 26 of the fabric piece 22 (shown in FIG. 7).

Figure 8:
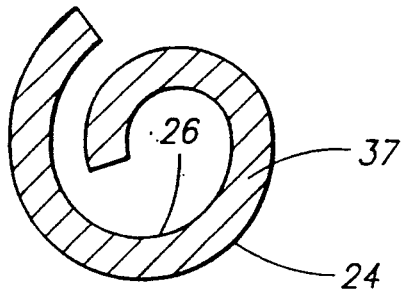
FIG. 8 is a top sectional view, taken along the line 8—8 of FIG. 4, of a strip of fabric material incorporated into the design shown in FIG. 4.

On the right side of FIG. 4, the fabric piece 22 is cut at an angle $\omega$ to form inclined fabric strips 37 that become helically twisted as they hang by gravity in a generally vertical position. The nature of the fabric piece 22 used to construct the clothing item 20 causes helical twisting when the fabric is cut at an inclined angle. In a preferred embodiment, the inclined, detached strips of fabric 37 are cut at approximately 45° relative to the horizontal axis. The fabric material used in the fabric piece 22 causes the inclined, detached strips 37 to become spiraled or twisted relative to their respective longitudinal axes, as shown in FIG. 8.

Figure 5:
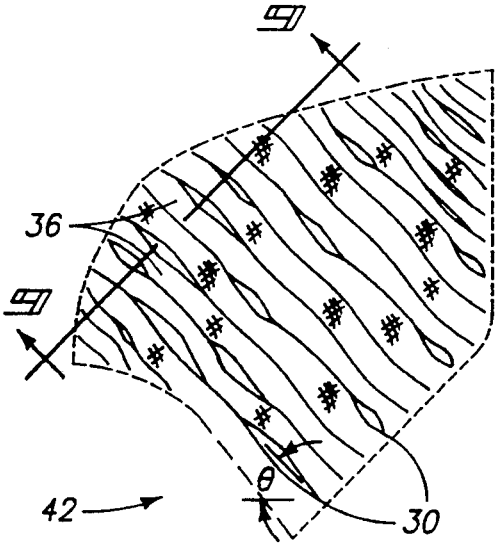
FIG. 5 is an enlarged, partial front view of still another design area on the item of clothing of FIG. 1.
Figure 9:
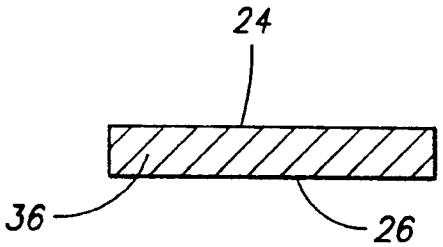
FIG. 9 is a sectional bottom view, taken along the line 9—9 of FIG. 5, of a strip of fabric material incorporated into the design of FIG. 5.

FIG. 5 shows another group of inclined fabric strips 36 which are formed by a plurality of inclined slits 30 oriented at an angle $\theta$. In a preferred embodiment shown in FIG. 5, angle $\theta$ is approximately 45°. As shown in FIG. 9, the inclined strips 32 remain substantially undistorted when the strips remain attached to the fabric piece 22 at both ends. This provides minimal viewing of the depiction 46 within visual area 42.

Figure 6:
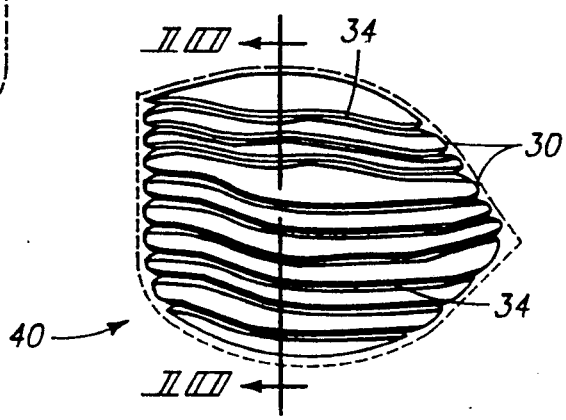
FIG. 6 is an enlarged, partial front view of yet another design area on the article of clothing of FIG. 1.
Figure 7:
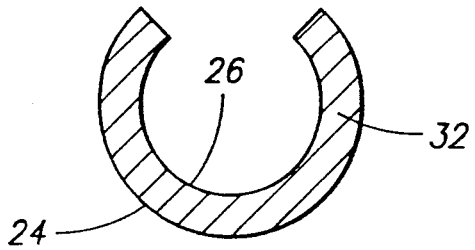
FIG. 7 is a top sectional view, taken along the line of 7—7 of FIG. 3, of a strip of fabric material incorporated into the design shown in FIG. 3.
Figure 10:
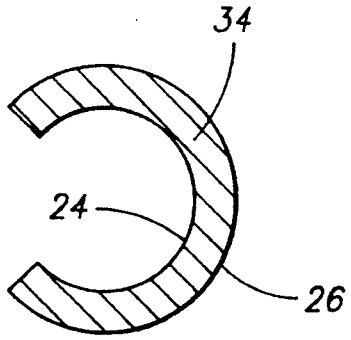
FIG. 10 is a sectional side elevational view, taken along the line 10—10 of FIG. 6, of a piece of fabric material incorporated into the design shown in FIG. 6.

FIG. 6 shows a visual area 40 which includes slits 30 oriented in a generally horizontal direction to form horizontal fabric strips 34. As shown in FIG. 10, the horizontal fabric strips 34 curl about their respective longitudinal axes in a direction toward the outer side 24 of the fabric piece. Such curling or cabling up of the fabric strips 34, in combination with the weight of the strips themselves, the exposes a significant amount of the depiction 39 on panel 48 located behind visual area 40.

A striking visual effect is created by combining the depiction 39 with the various combinations of cut fabric material within visual areas 38, 40, 42, 44. The patterns and designs shown in FIGS. 3, 4, 5, and 6 are simply representative of the many different possible designs and patterns that could be constructed according to the present invention.

Figure 11B:
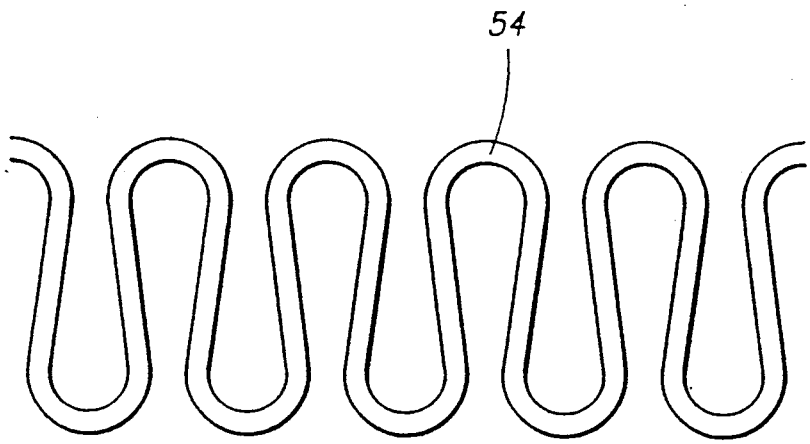
FIG. 11B is an enlarged front view of one thread of fabric used in the construction of the outerwear clothing item of FIG. 1.
Figure 11A:
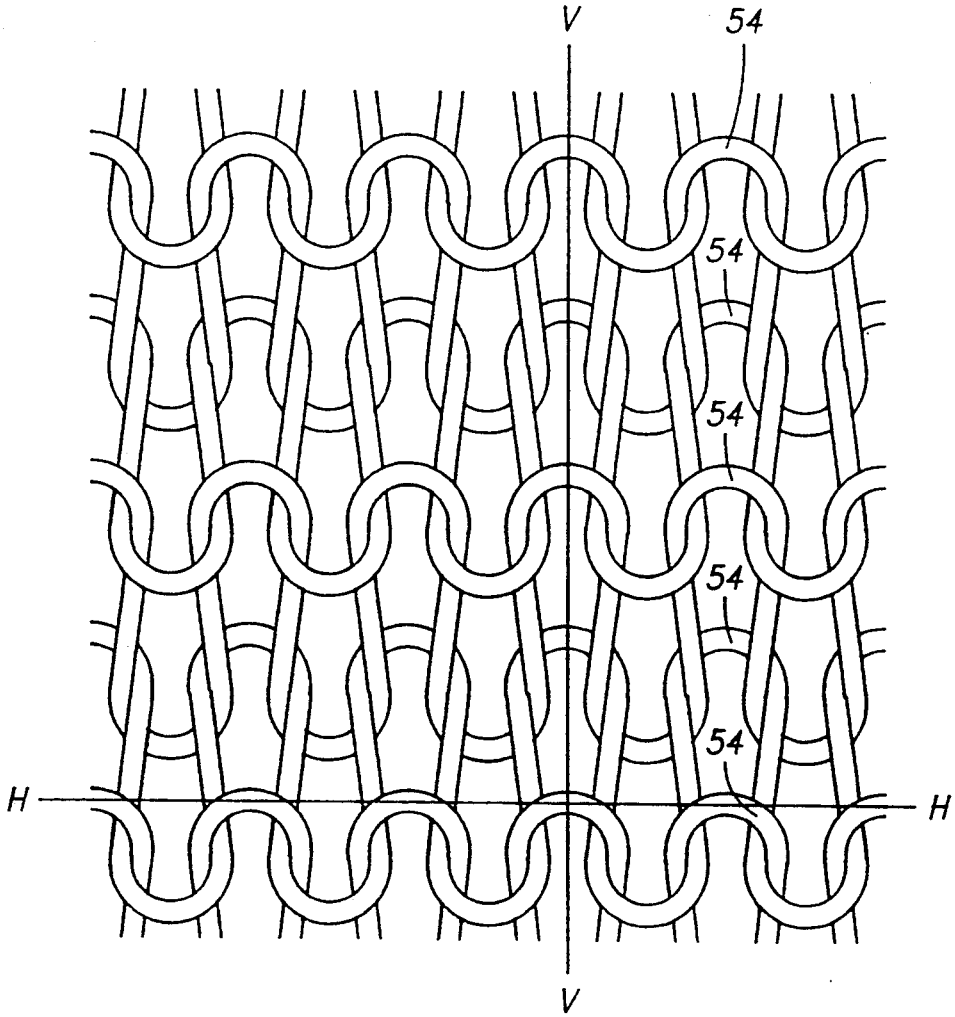
FIG. 11A is an enlarged view of the fabric material used in the construction of the outerwear clothing item shown in FIG. 1.

The varied distortion of the various strips of material, upon cutting the fabric into parallel strips in a variety of directions according to the present invention, results from the nature of the fabric used in the construction of the present invention, the length of the fabric strips, and the width of the fabric strips. FIG. 11A shows an enlarged view of a knitted fabric used in the present invention. Specifically, FIG. 11A shows a weft, single jersey knitted fabric which is constructed from looped chains of yarn or thread 54 which run horizontally across the width of the fabric material. The crosswise rows of loops are commonly called courses and the lengthwise rows of loops are called wales. Weft knits are more stretchable in the horizontal direction than in the vertical direction. The manner in which this fabric is constructed renders the fabric sensitive to curling and distortion when cut according to the present invention.

Distortion of the fabric strips also depends on the length and width of the strips. Longer strips tend to curl more than shorter strips and they have more flexibility to move greater distances. With respect to the width of the fabric strips, one preferred width has been found to be approximately ⅜ inch. With wider strips of fabric, more of the visual area is shown because increased curling results.

As shown in FIG. 11A, the weft knitted fabric used in the construction of clothing items according to the present invention includes a vertical fabric direction (along the wales), shown along the axis line V—V, and a horizontal fabric direction (along the courses), shown along the axis line H—H. As described above, cuts made in the fabric material at angles to the wales or courses produce curling to various degrees to create an unlimited number of designs, patterns, textures, and visual effects.

In constructing a clothing item 20 according to the present invention, a fabric material 22 is provided which consists of a weft knit, or more specifically, a weft, single jersey knitted fabric. The fabric is then cut multiple times within a visual area to form slits parallel to one another. The slits may be generally vertically oriented, horizontally oriented, or inclined. Many different visual areas 38, 40, 42, 44 may be created with the strips being cut at different angles. A panel 48 is then sewn to the fabric piece 22 around the periphery of the visual area 28 and along the fabric ribs 46 in between the individual visual areas 38, 40, 42, 44. A visual depiction 39 is positioned to be visible within the visual areas. The entire clothing item 20 is then wetted or immersed in water which causes the various strips of material 32, 33, 34, 36, 37 to become distorted in the various manners described above. The overall effect is an entirely unique outerwear garment which has tremendous consumer appeal and is highly durable.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A outerwear garment adapted to be worn by a person, comprising:

a fabric piece having an outer side and an inner side, the fabric piece being constructed in a manner to provide a horizontal fabric direction and a vertical fabric direction, the fabric piece being differentially stretchable in the horizontal and vertical fabric directions;

the fabric piece including a visual area having a plurality of substantially parallel slits in the fabric piece;

a display panel having a depiction on one side attached to the inner side of the fabric piece such that the depiction is partially visible through the parallel slits;

a plurality of fabric strips formed by the slits, the fabric strips being attached at each end to the fabric piece and being distorted relative to the fabric piece because of the differential stretching to allow portions of the depiction to be viewed through the parallel slits.

2. The outerwear garment of claim 1 wherein the fabric piece is knitted in a manner to allow the fabric to be stretched more in the horizontal fabric direction as compared to the vertical fabric direction.

3. The outerwear garment of claim 1 wherein the fabric piece is weft knitted such that the vertical fabric direction comprises multiple walls in the form of vertical columns of loops and the horizontal fabric direction comprises multiple courses in the form of horizontal rows of loops, the fabric being more stretchable in the horizontal fabric direction than in the vertical fabric direction.

4. The outerwear garment of claim 3 wherein the fabric piece is weft, single jersey knitted.

5. The outerwear garment of claim 1 wherein the slits are generally vertically oriented on the fabric piece to form generally vertically oriented strips of fabric, each strip having a longitudinal axis, the differential stretching of the fabric piece causing the vertical strips to curl inward toward the inner side of the fabric piece about their respective longitudinal axes to reveal increased portions of the depiction of the display panel.

6. The outerwear garment of claim 1 wherein the slits are generally horizontally oriented on the fabric piece to form generally horizontally oriented strips of fabric, each strip having a longitudinal axis, the differential stretching of the fabric causing the strips to curl outward toward the outer side of the fabric piece about each respective longitudinal axis to reveal increased portions of the depiction of the display panel.

7. The outerwear garment of claim 1 wherein the slits are oriented at an inclined angle relative to the horizontal fabric direction to form inclined strips of fabric, each strip having a longitudinal axis, the differential stretching of the fabric causing the inclined strips to remain substantially undistorted with respect to movement about their respective longitudinal axes to permit only limited viewing of the depiction through the slits.

8. The outerwear garment of claim 7 wherein the slits are oriented at an inclined 45° angle relative to the horizontal fabric direction to form the inclined strips of fabric.

9. The outerwear garment of claim 1 wherein the slits are oriented at an inclined angle relative to the horizontal fabric direction to form inclined strips of fabric, each strip having a longitudinal axis and detached at one end, the differential stretching of the fabric causing the inclined strips to become helically twisted about their respective longitudinal axes to permit increased viewing of the depiction through the slits.

10. The outerwear garment of claim 9 wherein the slits are oriented at an inclined 45° angle relative to the horizontal fabric direction to form the inclined strips of fabric.

11. The outerwear garment of claim 1 wherein the slits are oriented generally vertically on the fabric piece to form generally vertically oriented strips of fabric, each strip having a longitudinal axis, some of the vertically oriented strips being detached at one end from the fabric piece, the differential stretching of the fabric causing the strips to become distorted and curl about their longitudinal axes to expose increased portions of the depiction.

12. The outerwear garment of claim 1 wherein the slits comprise generally horizontally oriented slits and generally vertically oriented slits which form horizontal and vertical strips of fabric having respective longitudinal axes, the differential stretching of the fabric piece causing the horizontal strips to curl outward toward the outer side of the fabric piece and causing the vertical strips of fabric to curl inward toward inner side of the fabric piece about each respective axis to reveal increased portions of the depiction within the visual area.

13. A outerwear garment adapted to be worn by a person, comprising:

a fabric piece having an outer side and an inner side, the fabric piece being constructed in a manner to provide a horizontal fabric direction and a vertical fabric direction and being differentially stretchable in the horizontal and vertical fabric directions;

a first visual area defined by a plurality of parallel generally horizontal slits in the fabric piece, the horizontal slits forming horizontal strips of fabric, each having a longitudinal axis;

a second visual area defined by a plurality of parallel generally vertical slits in the fabric piece, the vertical slits forming vertical strips of fabric, each having a longitudinal axis;

a third visual area defined by a plurality of inclined slits in the fabric piece, the inclined slits forming inclined strips of fabric, each having a longitudinal axis;

multiple display panels, each having a depiction on one side and being attached to the inner side of the fabric piece so that the depictions are located within the visual areas;

the differential stretching of the fabric piece causing the horizontal strips to curl outward toward the outer side of the fabric piece about their respective longitudinal axes and causing the vertical strips of fabric to curl inward toward the inner side of the fabric piece about their respective longitudinal axes to reveal increased portions of the display panels located within the first and second visual areas; and the differential stretching of the fabric piece causing the inclined strips to remain substantially undistorted with respect to movement about their longitudinal sloping axes to reveal only a limited area of the display panel secured within the third visual area.

14. The outerwear garment of claim 13 wherein the fabric piece is knitted in a manner to allow the fabric to be stretched more in the horizontal fabric direction as compared to the vertical fabric direction.

15. The outerwear garment of claim 13 wherein the fabric piece is weft knitted such that the vertical fabric direction comprises multiple wales in the form of vertical columns of loops and the horizontal fabric direction comprises multiple courses in the form of horizontal rows of loops, the fabric being more stretchable in the horizontal fabric direction than in the vertical fabric direction.

16. The outerwear garment of claim 13 wherein the display panels are secured to the fabric piece along ribs of fabric which separate the visual areas.

17. A method of producing an outerwear garment adapted to be worn by a person, comprising the steps of:

providing a weft-knitted fabric piece having an inner side and an outer side, the fabric piece having a vertical fabric direction and a horizontal fabric direction, the vertical fabric direction including multiple wales in the form of vertical columns of loops, the horizontal fabric direction including multiple courses in the form of horizontal rows of loops;

cutting the fabric piece to form multiple, parallel generally vertical slits in a first visual area on the fabric piece, the vertical slits forming a plurality of vertical strips of fabric, each having a longitudinal axis;

cutting the fabric piece to form multiple, parallel generally horizontal slits in a second visual area on the fabric piece, the horizontal slits forming a plurality of horizontal strips of fabric, each having a longitudinal axis;

attaching a first panel to the inner side of the fabric piece to correspond with the first visual area, the first panel having a first depiction;

attaching a second panel to the inner side of the fabric piece to correspond with the second visual area, the second panel having a second depiction; and wetting the fabric piece to cause the vertical strips to curl inward about their respective longitudinal axes toward the inner side of the fabric piece to reveal increased portions of the first depiction within the first visual area, and to cause the horizontal strips to curl outward about their respective longitudinal axis toward the outer side of the fabric piece to reveal increased portions of the second depiction within the second visual area.

18. The method of claim 17, further comprising the steps of:

cutting the material piece to form inclined slits in a third visual area on the fabric piece, the inclined slits forming a plurality of inclined strips of fabric, each having a longitudinal axis;

attaching a third display panel to the inner side of the fabric piece to correspond with the third visual area, the third display panel having a third depiction;

detaching one end of each inclined strip of fabric; and wetting the inclined strips of fabric to cause the inclined strips to become helically twisted about their respective longitudinal axes to reveal increased portions of the third depiction through the slits.

19. The method of claim 17, further comprising the step of cutting the material piece to form inclined slits in a third visual area on the fabric piece, the inclined slits forming a plurality of inclined strips of fabric, each having a longitudinal axis;

attaching a third display panel to the inner side of the fabric piece to correspond with the third visual area, the third display panel having a third depiction; and wetting the inclined strips of fabric to cause the inclined strips to remain substantially undistorted to reveal only minimal portions of the third depiction through the slits.

20. The method of claim 17 further comprising the step of:

detaching one end of alternating vertical strips of fabric.

21. The method of claim 20 wherein a top end of each alternating strip of fabric is detached such that the strip of material hangs vertically from an attached bottom end to reveal increased portions of the first depiction.

* * * * *